US006773034B1

(12) United States Patent
Melcher

(10) Patent No.: US 6,773,034 B1
(45) **Date of Patent: *Aug. 10, 2004**

(54) BOOK AND METHOD FOR MAKING A BOOK

(75) Inventor: Charles H. Melcher, New York, NY (US)

(73) Assignee: Melcher Media, Inc., New York, NY (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/410,291

(22) Filed: Sep. 30, 1999

(51) Int. Cl.[7] ..... B42D 1/00

(52) U.S. Cl. ..... 281/38; 281/15.1; 281/21.1; 412/1; 412/8; 412/37

(58) Field of Search ..... 412/37, 35, 1, 412/6, 8; 281/15.1, 21.1, 36, 37, 38

(56) References Cited

U.S. PATENT DOCUMENTS

| | | | | | |
|---|---|---|---|---|---|
| 3,944,763 | A | * | 3/1976 | Beierwaltes | 200/52 R |
| 4,041,883 | A | * | 8/1977 | Meratti | 412/35 X |
| 4,371,194 | A | * | 2/1983 | Wang et al. | 281/21.1 |
| 4,371,195 | A | * | 2/1983 | Wang et al. | 281/21.1 |
| 4,593,418 | A | * | 6/1986 | Simon | 112/417 |
| 4,733,774 | A | * | 3/1988 | Ping, III et al. | 206/0.5 |
| 4,750,956 | A | * | 6/1988 | Malachowski | 412/37 X |
| 5,129,772 | A | * | 7/1992 | Slautterback | 412/37 X |
| 5,156,510 | A | * | 10/1992 | Uehara | 412/37 X |
| 5,165,500 | A | * | 11/1992 | Bass | 182/187 |
| 5,186,457 | A | * | 2/1993 | Cole | 273/58 K |
| 5,193,851 | A | * | 3/1993 | Honegger | 281/15.1 |
| 5,233,924 | A | * | 8/1993 | Ohba et al. | 101/483 |
| 5,464,253 | A | * | 11/1995 | Farrell | 281/51 X |
| 5,489,471 | A | * | 2/1996 | Inoue et al. | 428/195 |
| 5,542,800 | A | * | 8/1996 | Detterman et al. | 412/37 X |
| 5,885,679 | A | * | 3/1999 | Yasue et al. | 156/73.4 |

FOREIGN PATENT DOCUMENTS

| | | | |
|---|---|---|---|
| CA | 870196 | * | 5/1971 |
| JP | 409183278 | * | 7/1997 |
| JP | 410029386 | * | 2/1998 |

* cited by examiner

*Primary Examiner*—Monica S. Carter
(74) *Attorney, Agent, or Firm*—Bruce D. Gray; Kilpatrick Stockton LLP

(57) ABSTRACT

A process and product therefrom for making a waterproof, durable and easily printed book with a plurality of pages of synthetic paper bound by water-insoluble adhesive or glue and/or water-resistant thread. A preferred embodiment is prepared with a series of depressions or wells into which water-insoluble adhesive or glue is introduced before the insertion of the pages therein, the pages being tightly bound together and to the cover backing by a combination of adhesive or glue and water-insoluble thread.

19 Claims, 4 Drawing Sheets

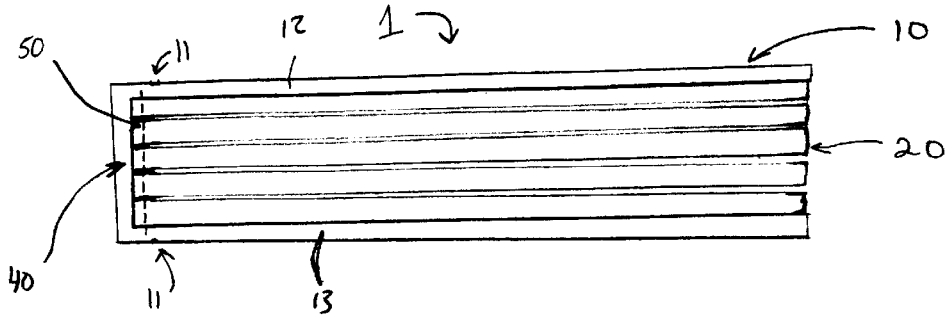
Fig. 3a
Fig. 3b
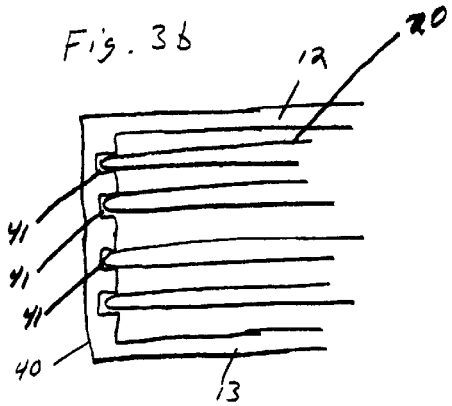

BOOK AND METHOD FOR MAKING A BOOK

FIELD OF THE INVENTION

The present invention relates generally to a book and the method for making a book. More particularly, the present invention relates to a book which uses synthetic water-proof paper in combination with a water-proof glue and/or water resistant thread for binding the pages of the book thereby reducing the possibility of their separation in the event the book becomes exposed to moisture.

BACKGROUND OF THE PRESENT INVENTION

It is known that there are on the market many different types of paper for use in the creation of books. Most traditional paper is made of wood fiber, or other cellulose fibrous materials, which has significant disadvantages, including low durability, low tear-resistence, and high water, chemical and scuff susceptibility. Also, the profit margin associated with fiber based paper products is low.

Synthetic paper adds a creative and durable dimension to projects to achieve dynamic designs that are marketably distinct and appealing. Because they contain little or no wood fiber, synthetics can be fully submerged in water without degrading. Thus, they are ideal for applications where contact with water is possible. High pliability along with high tear-resistence, high tensile strength, and high chemical and scuff resistence also create a number of unique advantages over traditional wood fiber-based paper. Due to its unique properties, synthetic paper is ideal for many printing and publishing applications.

For example, U.S. Pat. No. 5,233,924 teaches a synthetic paper for writing and printing which adds a unique dimension to printing jobs for which traditional, wood and cotton fiber based, paper simply does not provide a medium of choice, particularly where the resulting product is likely to come into contact with water.

Heretofore, however, bound books created with synthetic paper have been bound with water soluble glues and/or threads made out of natural materials (such as cotton) which rapidly degrade in the presence of water. The problem of binding synthetic paper is also complicated by its higher weight, lower compressability and lower frictional coefficient between sheets. There is therefore a need for a method of binding synthetic paper in a book which will resist degrading when exposed to water.

SUMMARY OF THE INVENTION

The present invention provides a method for the creation of a book which incorporates synthetic paper, and thus all the advantages thereof. According to the process of the invention, a conventional cover comprising two leafs and a spine between them is made of synthetic paper, such as that made from polypropylene. The spine is prepared so as to be able to receive a sufficient amount of water insoluble glue for achieving binding. In a preferred embodiment, this is achieved using a series of depressions or wells into which water insoluble glue can be introduced. Thereafter, the synthetic pages, which have been assembled in two-page clusters beforehand, are inserted into the spine wells and adhesively secured thereto. In a preferred embodiment, the cover and pages are then be tightly bound with water-resistant thread such as nylon. In an alternate embodiment, the pages may be bound using water-resistant thread alone. The cover may be prepared with two vertical score lines adjacent to the place where the spine and cover meet.

The above and other features and advantages of the present invention will be readily apparent from the following detailed description of the invention taken in conjunction with the accompanying drawings wherein like reference characters represent like elements, the scope of the invention being set out in the appended claims.

BRIEF DESCRIPTION OF THE DRAWINGS

For a more complete understanding of the present invention, reference is made to the following Detailed Description taken in conjunction with the accompanying drawings in which.

DETAILED DESCRIPTION

The term "book" as used herein includes any combination of pages and cover or backing, such as magazines, brochures, pamphlets, catalogues, albums, manuals, memos or any artifact having a combination of pages and a cover that can be manufactured by a process of, or including, binding. The present invention thus provides a process by which a book is made and also provides the book which results from that process.

Figure 1:
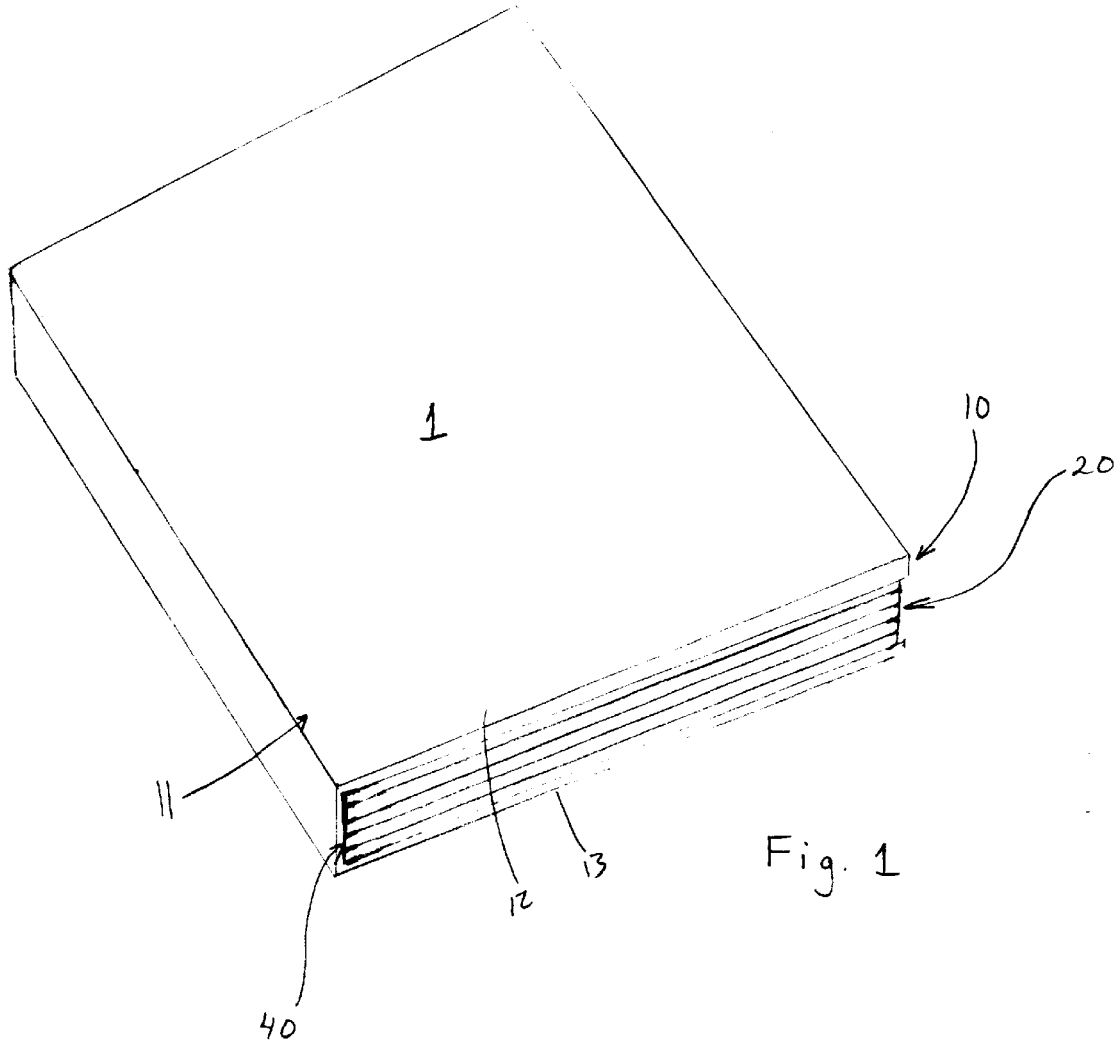
FIG. 1 is a perspective view of a book in accordance with a preferred embodiment of the invention seen in a closed condition.
Figure 2:
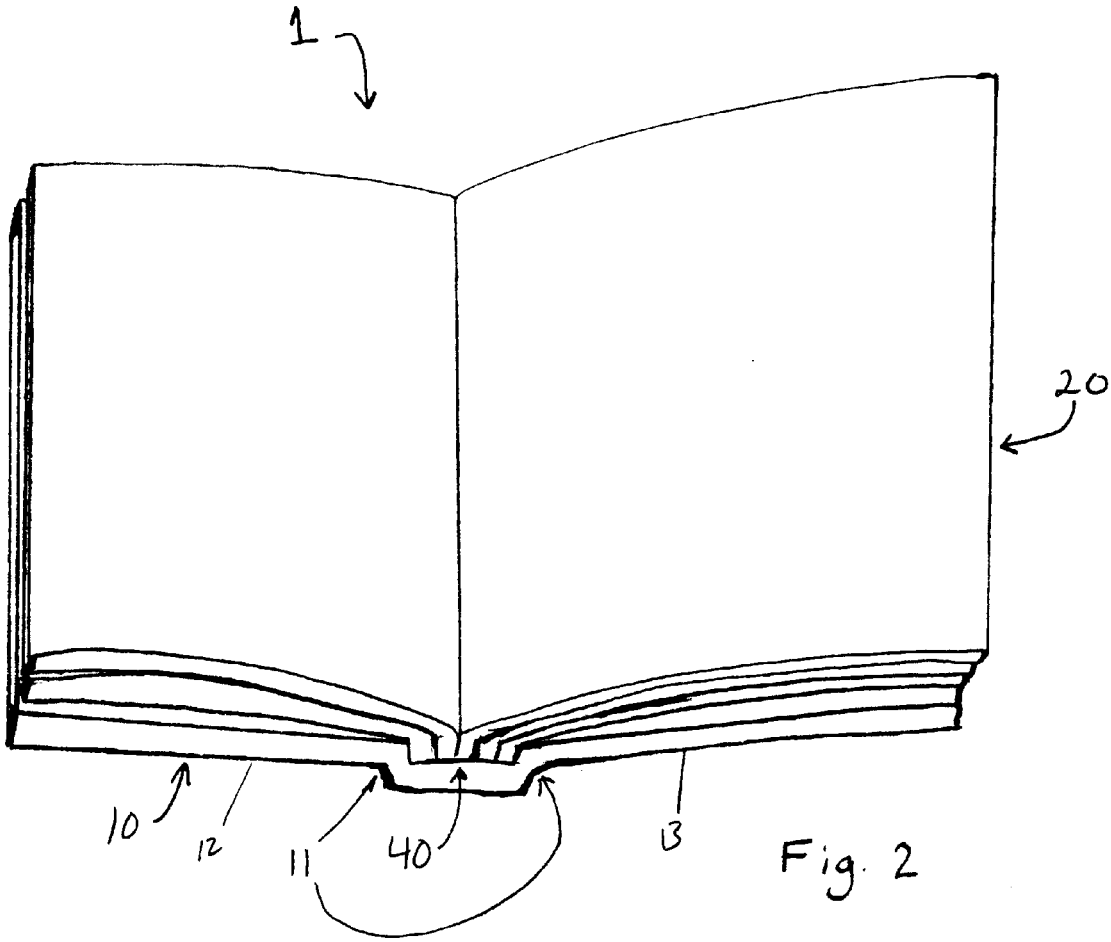
FIG. 2 is a perspective view of the book shown in FIG. 1 in an open condition.
Figure 4:
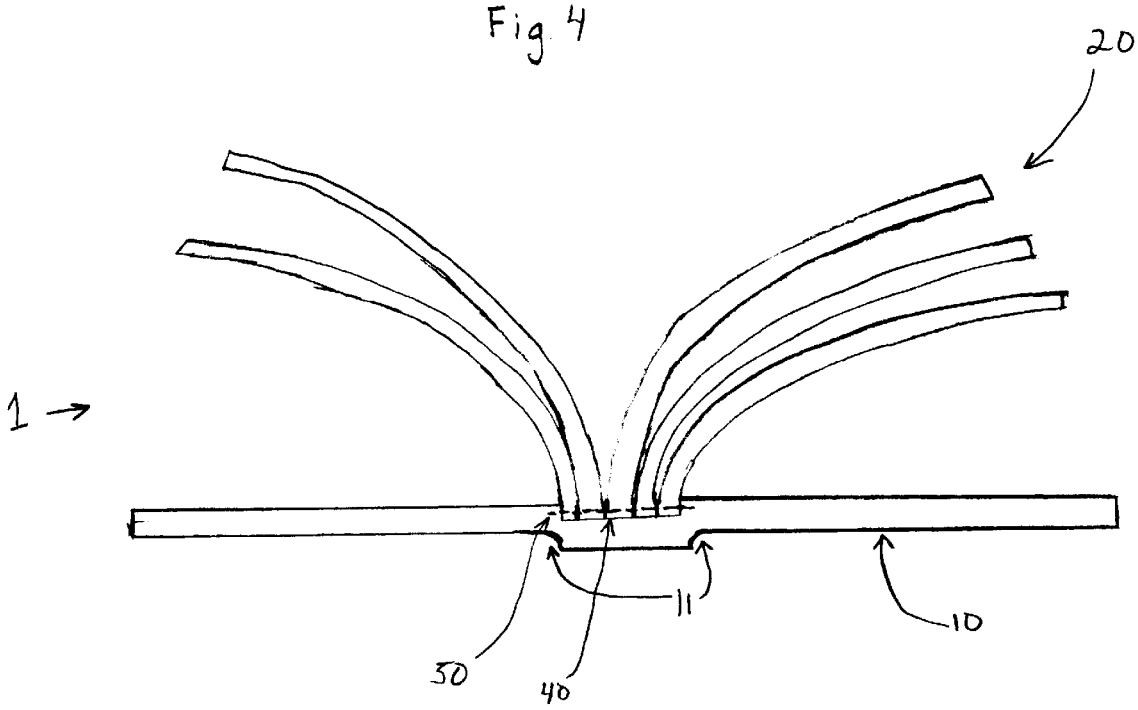
FIG. 4 is a plan view of an open book in accordance with a preferred embodiment of the present invention.
Figure 1:
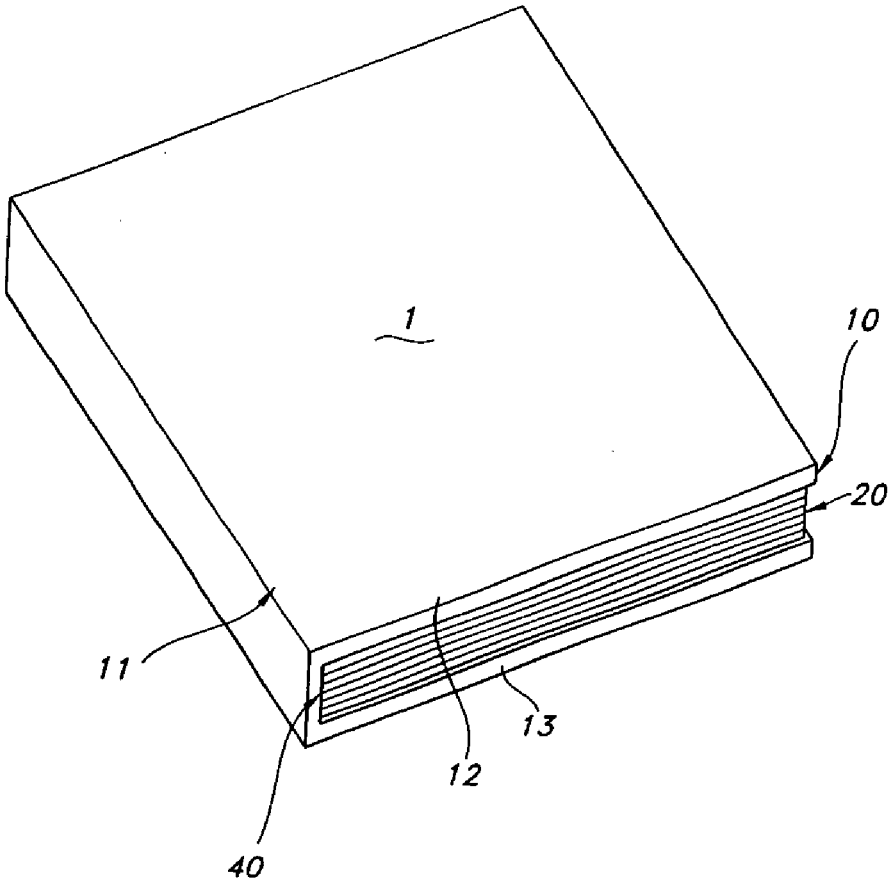
Figure 2:
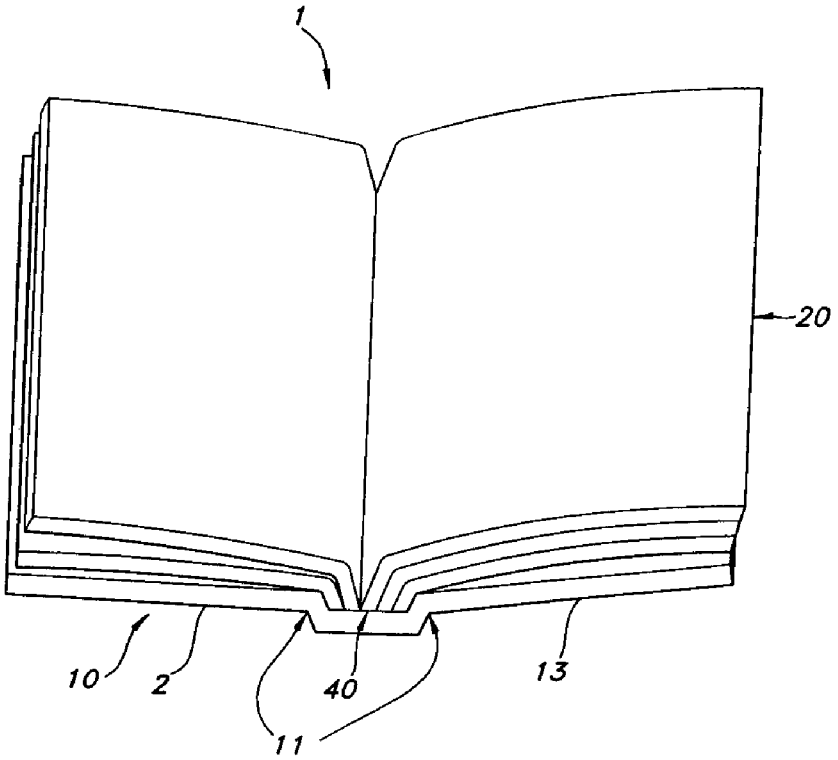
Figure 3A:
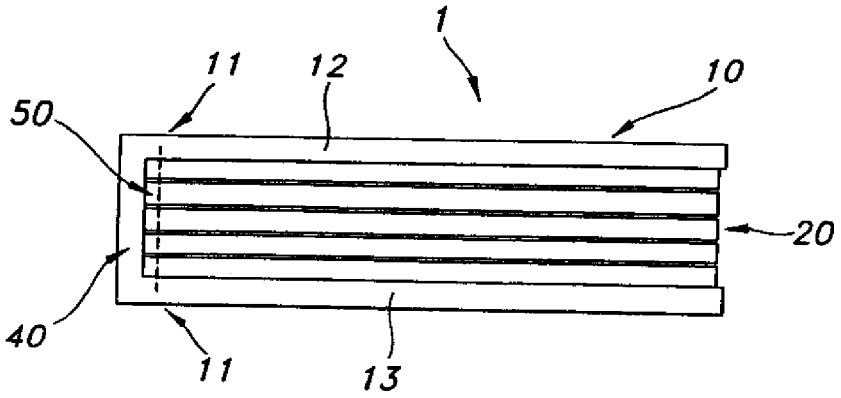
FIGS. 3*a* and 3*b* are plan views of a book in accordance with a preferred embodiment of the present invention.
Figure 3B:
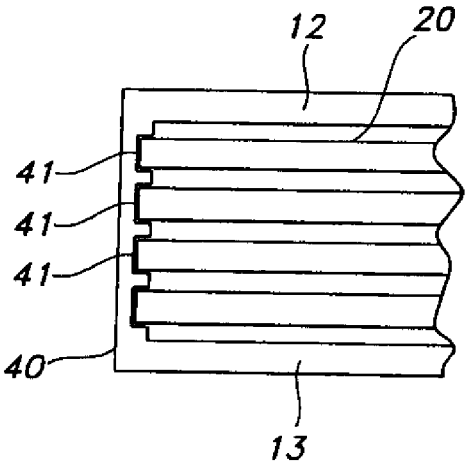
Figure 4:
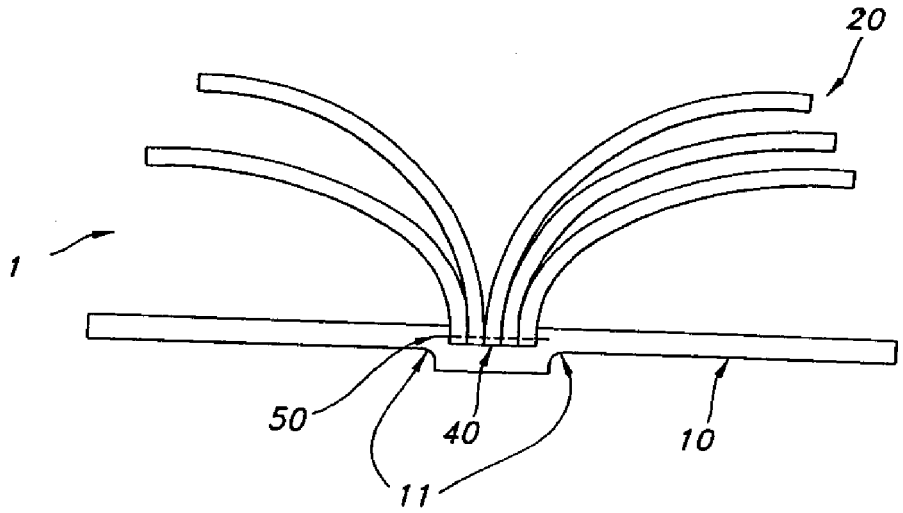

With reference to FIGS. 1–4, book 1 includes cover 10 and pages 20 which are secured to each other at the spine 40.

Properties considered when selecting a synthetic paper 20 to be used for the creation of the invention include opacity, bulk, caliper, temperature stability, recycle-ability, ink hold out, drying time, and tear strength. A preferred embodiment uses Nan Ya P.P. Synthetic Paper manufactured by Nan Ya Plastic Corporation. Additionally, paper manufactured by Yupo Corporation is suitable.

Paper currently available which is preferred has specifications approximately: about 0.10 mm–0.20 mm thickness, about 10 mm–790 mm width, and 10 mm–550 mm length. However, synthetic paper of any width or length is acceptable and synthetic paper with thickness up to about 0.5 mm or more is acceptable. Any width and length of pages to be used in the book can be created by cutting the desired size and shape from a given sheet of synthetic paper. As the size of synthetic paper enlarges, so does the possible size of books possible as a result of the teachings of this inventive process.

Cover 10 is likewise preferably made of synthetic paper and will generally be, but is not required to be, of a thickness greater than that of the pages 20. Cover 10 includes top 12, bottom 13 and spine 40. Spine 40 is bound to the pages 20. Spine 40 includes series of depressions or wells 41 into which an adhesive or glue is introduced. Wells 41 preferably have roughened surface to facilitate the placement and retention of the glue required for the binding. Pages 20 are preferably folded over and inserted into wells 41. In this manner one page 20 provides four visible sides. Optionally more than one page 20 may be inserted into each well 41.

Cover 10 may be scored with two vertical score lines 11 preferably adjacent to the place where the spine 40 and cover 10 meet to make it pliable in order to facilitate the book being in an open position.

The cover 10 and pages 20 are bound together through the use of a water-insoluble adhesive or glue (the terms "adhesive" and "glue" being used interchangeable herein) and synthetic water-resistant thread 50. Although, an adhesive or glue alone can suffice to complete the requisite binding, it is preferred that thread 50 also be used to further reinforce the book construction. Some synthetic paper is directional and when binding such synthetic paper, the edge of the book to be 20 bound must be vertical to the direction of grain to guarantee strength when the pages are turned.

Water-insoluble adhesive or glue is to be used to adhere the pages to each other and to the cover. Consistency and drying as well as compatibility and tendency to degrade or discolor in the presence of water are considerations in the choice of a particular water insoluble glue to be used in the binding process. A preferred embodiment uses Instant Lok 34-2787 glue manufactured by National Starch and Chemical Company.

The pages 20 and cover 10 can be, and are preferably, further bound by water-insoluble thread 50 with good strength and durability. Since pure cotton thread rots easily, water-resistant thread is used. A preferred water-resistant thread is Core-spun Cotton/Polyester thread manufactured by Total Thread Company. The weight of the water-resistant thread is important to prevent tearing of the text pages and also breaks during binding. At the time of this disclosure, a preferred machine to perform the binding is the Miller Martini Rotary Binder. The stitching for effect of the binding will be carried out in the conventional manner.

Although the invention may have commercial and practical application as a compilation of blank pages inside a blank cover, it is most desirable to produce a book which includes text and/or graphics. Such text and/or graphics can be printed and/or embossed, or otherwise transposed onto the synthetic paper. A preferred ink is Ink-Goes-G manufactured by Dai Nippon Ink and Chemical Ltd. which was found to react best with the preferred paper because the ink was not absorbed by the paper. Normal amounts of drying powder are applied to the sheets and sufficient drying time is given before printing a second side or before folding. Typically printing speed is 30% slower than printing on natural paper.

It will be appreciated by one of ordinary skill in the art that the principles of the present invention may be applied to provide a process for the fabrication of pamphlets, booklets, brochures, catalogues, magazines, albums, manuals, menus, or any other use for a combination of pages and a cover.

While the foregoing description and drawings represent the preferred embodiments of the present invention, it will be understood that various additions, modifications and substitutions may be made therein without departing from the spirit and scope of the present invention as defined in the accompanying claims. The presently disclosed embodiments are therefore to be considered in all respects as illustrative and not restrictive, the scope of the invention being indicated by the appended claims, and not limited to the foregoing description.

What is claimed is:

1. A durable, water-resistant book comprising:

a cover having a top, a bottom and a spine; and a plurality of sheets of synthetic water-proof paper, said sheets being bound to said spine by a water-insoluble glue, wherein the book is suitable for use where contact with water is possible.

2. The book of claim 1, wherein the cover comprises synthetic paper.

3. A durable, water-resistant book comprising:

a cover having a top, a bottom and a spine; and a plurality of sheets of synthetic water-proof paper, said sheets being bound to said spine by a water-resistant thread, wherein the book is suitable for use where contact with water is possible.

4. The book claim 3 wherein said water-resistant thread is nylon.

5. The book of claim 3 wherein said water-resistant thread is core-spun cotton/polyester.

6. The book of claim 3 wherein said sheets are further bound by water-insoluble glue.

7. The book of claim 3, wherein the cover comprises synthetic paper.

8. A durable, water-resistant book comprising:

a cover having a top, a bottom and a spine, said spine having a plurality of longitudinal wells, said wells being provided with water-insoluble glue; and a plurality of sheets of synthetic water-proof paper, each said sheet having a first edge, each said first edge being inserted into said wells, whereby said wells and water-insoluble glue act to secure said paper, and wherein the book is suitable for use where contact with water is possible.

9. The book of claim 8, wherein said sheets of synthetic paper are folded over to form said first edge, whereby each said sheet provides four sides of viewable paper.

10. The book of claim 8, wherein said wells provide a roughened surface for securing said sheets.

11. The book of claim 9, wherein a single sheet of synthetic paper is inserted into each said well.

12. The book of claim 8, wherein said cover comprises synthetic paper, said cover being secured along a line substantially adjacent to said spine to facilitate opening said cover.

13. A method for making a durable, water-resistant book having a cover including a top, bottom and spine, and a plurality of sheets of synthetic water-proof paper, said method comprising:

creating a series of longitudinal wells in said spine;

inserting water-insoluble glue into said wells; and inserting said synthetic paper into said wells wherein the book is suitable for use where contact with water is possible.

14. The method of claim 13 further comprising the step of folding over said pages prior to insertion into said wells.

15. The method of claim 13 further comprising:

scoring said top and bottom of said cover substantially adjacent to said spine to facilitate opening said cover.

16. A durable, water-resistant book comprising:

a cover having a top, a bottom and a spine; and a plurality of sheets of water-proof synthetic paper, said sheets being bound to said spine by a water-insoluble glue or water-resistant thread, or both.

17. The book of claim 16, wherein the synthetic paper is chemical-resistant.

18. The book of claim 16, wherein the synthetic paper is tear-resistant.

19. The book of claim 16, wherein the synthetic paper is scuff-resistant.

* * * * *

UNITED STATES PATENT AND TRADEMARK OFFICE

CERTIFICATE OF CORRECTION

PATENT NO. : 6,773,034 B1
DATED : August 10, 2004
INVENTOR(S) : Charles H. Melcher It is certified that error appears in the above-identified patent and that said Letters Patent is hereby corrected as shown below:

Drawings,
Replace old drawings with these new drawings

Column 1,
Lines 21 and 31, delete “resistence” and substitute -- resistance --

Column 3,
Line 7, delete “interchangeable” and substitute -- interchangeably --

Signed and Sealed this

Eighth Day of March, 2005

JON W. DUDAS
*Director of the United States Patent and Trademark Office*

(12) United States Patent
Melcher

(10) Patent No.: US 6,773,034 B1
(45) **Date of Patent: *Aug. 10, 2004**

(54) BOOK AND METHOD FOR MAKING A BOOK

(75) Inventor: Charles H. Melcher, New York, NY (US)

(73) Assignee: Melcher Media, Inc., New York, NY (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/410,291

(22) Filed: Sep. 30, 1999

(51) Int. Cl.[7] ..... B42D 1/00

(52) U.S. Cl. ..... 281/38; 281/15.1; 281/21.1; 412/1; 412/8; 412/37

(58) Field of Search ..... 412/37, 35, 1, 412/6, 8; 281/15.1, 21.1, 36, 37, 38

(56) References Cited

U.S. PATENT DOCUMENTS

| | | | | | |
|---|---|---|---|---|---|
| 3,944,763 | A | * | 3/1976 | Beierwaltes | 200/52 R |
| 4,041,883 | A | * | 8/1977 | Meratti | 412/35 X |
| 4,371,194 | A | * | 2/1983 | Wang et al. | 281/21.1 |
| 4,371,195 | A | * | 2/1983 | Wang et al. | 281/21.1 |
| 4,593,418 | A | * | 6/1986 | Simon | 112/417 |
| 4,733,774 | A | * | 3/1988 | Ping, III et al. | 206/0.5 |
| 4,750,956 | A | * | 6/1988 | Malachowski | 412/37 X |
| 5,129,772 | A | * | 7/1992 | Slautterback | 412/37 X |
| 5,156,510 | A | * | 10/1992 | Uehara | 412/37 X |
| 5,165,500 | A | * | 11/1992 | Bass | 182/187 |
| 5,186,457 | A | * | 2/1993 | Cole | 273/58 K |
| 5,193,851 | A | * | 3/1993 | Honegger | 281/15.1 |
| 5,233,924 | A | * | 8/1993 | Ohba et al. | 101/483 |
| 5,464,253 | A | * | 11/1995 | Farrell | 281/51 X |
| 5,489,471 | A | * | 2/1996 | Inoue et al. | 428/195 |
| 5,542,800 | A | * | 8/1996 | Detterman et al. | 412/37 X |
| 5,885,679 | A | * | 3/1999 | Yasue et al. | 156/73.4 |

FOREIGN PATENT DOCUMENTS

| | | | |
|---|---|---|---|
| CA | 870196 | * | 5/1971 |
| JP | 409183278 | * | 7/1997 |
| JP | 410029386 | * | 2/1998 |

* cited by examiner

*Primary Examiner*—Monica S. Carter
(74) *Attorney, Agent, or Firm*—Bruce D. Gray; Kilpatrick Stockton LLP

(57) ABSTRACT

A process and product therefrom for making a waterproof, durable and easily printed book with a plurality of pages of synthetic paper bound by water-insoluble adhesive or glue and/or water-resistant thread. A preferred embodiment is prepared with a series of depressions or wells into which water-insoluble adhesive or glue is introduced before the insertion of the pages therein, the pages being tightly bound together and to the cover backing by a combination of adhesive or glue and water-insoluble thread.

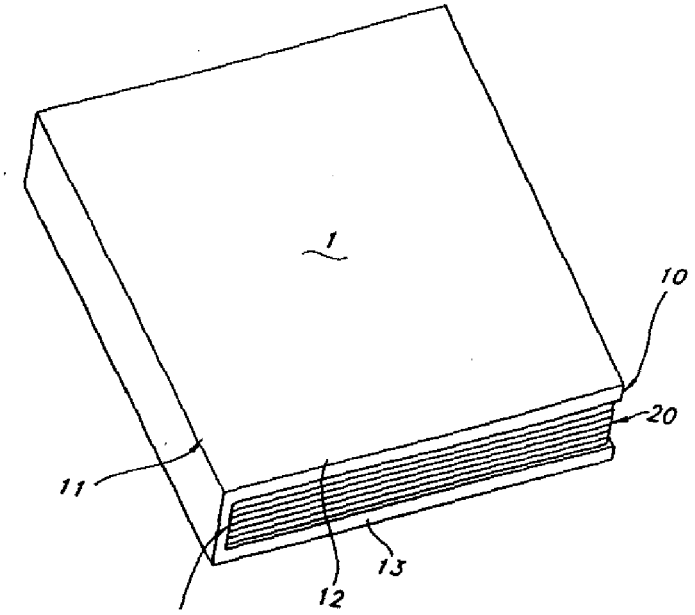

19 Claims, 4 Drawing Sheets